US011988206B2

(12) United States Patent
Namiki

(10) Patent No.: US 11,988,206 B2
(45) Date of Patent: May 21, 2024

(54) SCROLL COMPRESSOR WITH GROOVES AND AUXILIARY DISCHARGE PORTS

(71) Applicant: KABUSHIKI KAISHA TOYOTA JIDOSHOKKI, Kariya (JP)

(72) Inventor: Ken Namiki, Kariya (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 0 days.

(21) Appl. No.: 18/174,276

(22) Filed: Feb. 24, 2023

(65) Prior Publication Data

US 2023/0296092 A1 Sep. 21, 2023

(30) Foreign Application Priority Data

Mar. 15, 2022 (JP) ..... 2022-040088

(51) Int. Cl.

| | |
|---|---|
| ***F04C 18/02*** | (2006.01) |
| ***F04C 2/02*** | (2006.01) |
| ***F04C 23/00*** | (2006.01) |
| ***F04C 28/24*** | (2006.01) |
| ***F04C 29/12*** | (2006.01) |

(52) U.S. Cl.

CPC ..... *F04C 18/0261* (2013.01); *F04C 2/025* (2013.01); *F04C 18/0215* (2013.01); *F04C 18/0253* (2013.01); *F04C 28/24* (2013.01); *F04C 29/128* (2013.01); *F04C 23/008* (2013.01)

(58) Field of Classification Search

CPC ..... F04C 2/025; F04C 18/0207–0292; F04C 14/24–26; F04C 28/24–26; F01C 1/0207–0292; F01C 20/24–26

See application file for complete search history.

(56) References Cited

U.S. PATENT DOCUMENTS

| | | | | |
|---|---|---|---|---|
| 6,430,959 | B1 * | 8/2002 | Lifson | F04C 29/0007 62/468 |
| 2006/0269432 | A1 * | 11/2006 | Lifson | F04C 18/0215 418/55.6 |
| 2010/0135836 | A1 * | 6/2010 | Stover | F04C 18/0261 418/55.2 |
| 2010/0303659 | A1 * | 12/2010 | Stover | F04C 29/0007 418/24 |
| 2023/0103065 | A1 * | 3/2023 | Ziolkowski, Jr. | F04C 18/0253 418/55.1 |

FOREIGN PATENT DOCUMENTS

JP 61-223288 A 10/1986

* cited by examiner

*Primary Examiner* — Laert Dounis
(74) *Attorney, Agent, or Firm* — Sughrue Mion, PLLC

(57) ABSTRACT

A scroll compressor includes a fixed scroll and an orbiting scroll. A base plate of at least one of the fixed scroll and the orbiting scroll includes an auxiliary discharge port and a groove. The groove is partially covered with an orbiting volute wall facing the groove, so that a compression chamber that is in a compression process and is connected to the auxiliary discharge port is not connected to other compression chambers in a compression process or to a compression chamber connected to a main discharge port. The groove is always connected to one of the compression chambers.

6 Claims, 7 Drawing Sheets

SCROLL COMPRESSOR WITH GROOVES AND AUXILIARY DISCHARGE PORTS

BACKGROUND

1. Field

The present disclosure relates to a scroll compressor.

2. Description of Related Art

A scroll compressor includes a fixed scroll and an orbiting scroll. The fixed scroll includes a fixed base plate and a fixed volute wall. The fixed volute wall extends from the fixed base plate. The orbiting scroll includes an orbiting base plate and an orbiting volute wall. The orbiting base plate is opposed to the fixed base plate. The orbiting volute wall extends toward the fixed base plate from the orbiting base plate. The orbiting volute wall meshes with the fixed volute wall. The fixed scroll and the orbiting scroll define compression chambers. The fixed base plate includes a main discharge port at the center. The main discharge port discharges compressed fluid.

In such a scroll compressor, if liquid refrigerant is drawn into a compression chamber, liquid compression may occur in the compression chamber. If liquid compression occurs in a compression chamber, the pressure in the compression chamber may become abnormally high. If such over compression occurs in a compression chamber, the fixed volute wall and the orbiting volute wall may be deformed, reducing the reliability of the scroll compressor.

In this regard, Japanese Laid-Open Patent Publication No. 61-223288 discloses a scroll compressor including auxiliary discharge ports. In the scroll compressor of the publication, the auxiliary discharge ports extend through the volute wall and the base plate in at least one of the fixed scroll and the orbiting scroll. The auxiliary discharge ports discharge the fluid in a compression chamber when the pressure in the compression chamber becomes greater than or equal to a preset pressure. With this configuration, even if liquid refrigerant is drawn into the compression chamber, the liquid refrigerant is discharged from the auxiliary discharge port before the pressure in the compression chamber becomes abnormally high. This prevents the pressure in the compression chamber from being abnormally high.

However, in the structure in which auxiliary discharge ports extend through a volute wall as disclosed in the above publication, the volute wall needs to be designed to have a large width in order to form auxiliary discharge ports in the volute wall. The volume of each compression chamber is reduced by an amount corresponding to the increase in the width of the volute wall. If the volute wall is designed to have a large width without reducing the volume of each compression chamber, the size of the scroll compressor is inevitably increased.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a scroll compressor is provided that includes a fixed scroll that includes a fixed base plate and a fixed volute wall extending from the fixed base plate, and an orbiting scroll that includes an orbiting base plate and an orbiting volute wall. The orbiting base plate faces the fixed base plate. The orbiting volute wall extends from the orbiting base plate toward the fixed base plate and meshes with the fixed volute wall. The fixed scroll and the orbiting scroll define compression chambers. The fixed base plate includes a main discharge port at a center of the fixed base plate. The main discharge port discharges a compressed fluid. At least one of the fixed base plate or the orbiting base plate includes an auxiliary discharge port located at a position different from a position of the main discharge port. The auxiliary discharge port is configured to discharge fluid in one of the compression chambers when a pressure in the compression chamber becomes greater than or equal to a preset pressure. The fixed base plate and the orbiting base plate include volute wall forming surfaces provided with corresponding volute walls. The volute wall forming surface of the base plate that includes the auxiliary discharge port includes an opening of the auxiliary discharge port. The base plate also includes a groove connected to the opening. The groove is configured to be always connected to one of the compression chambers. The groove is configured to be partially covered with the volute wall facing the groove, so that the compression chamber that is in a compression process and is connected to the auxiliary discharge port is not connected to other compression chambers in a compression process or to the compression chamber connected to the main discharge port.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

A scroll compressor 10 according to one embodiment will now be described with reference to FIGS. 1 to 17. The scroll compressor 10 of the present embodiment is used, for example, in a vehicle air conditioner.

<Basic Configuration of Scroll Compressor 10>

Figure 1:
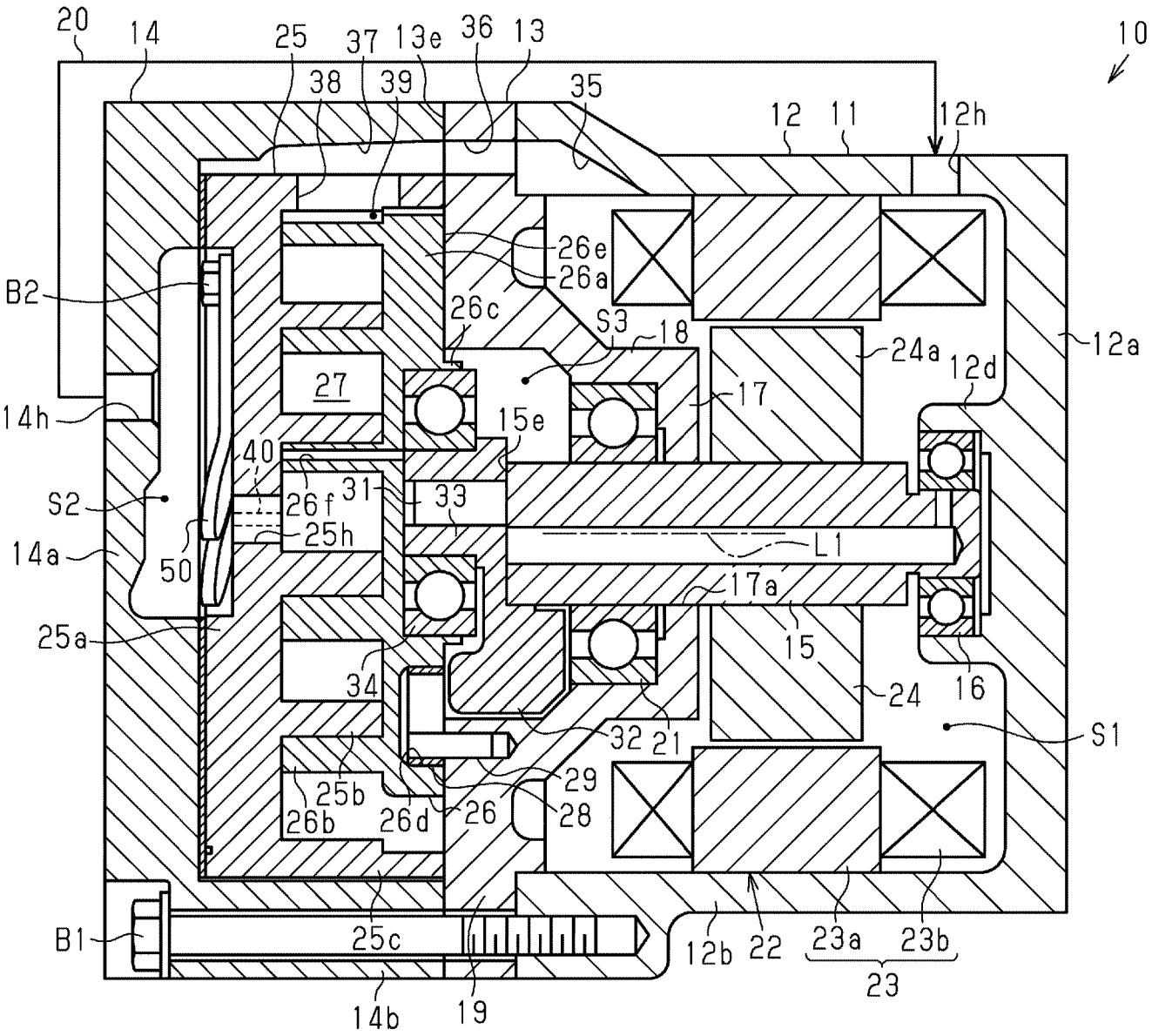
FIG. 1 is a cross-sectional side view showing a scroll compressor according to an embodiment.

As shown in FIG. 1, the scroll compressor 10 includes a tubular housing 11. The housing 11 includes a motor housing member 12, a shaft support housing member 13, and a discharge housing member 14. The motor housing member 12, the shaft support housing member 13, and the discharge housing member 14 are made of metal. The motor housing member 12, the shaft support housing member 13, and the discharge housing member 14 are made of, for example, aluminum. The scroll compressor 10 includes a rotary shaft 15, which is accommodated in the housing 11.

The motor housing member 12 includes a plate-shaped end wall 12*a* and a tubular peripheral wall 12*b*. The peripheral wall 12*b* tubularly extends from the outer periphery of the end wall 12*a*. The axial direction of the peripheral wall 12*b* agrees with the axial direction of the rotary shaft 15. The motor housing member 12 includes an inlet 12*h*. The inlet 12*h* is formed in the peripheral wall 12*b*. The inlet 12*h* is formed at a position in the peripheral wall 12*b* that is relatively close to the end wall 12*a*. The inlet 12*h* connects the inside and the outside of the motor housing member 12 to each other. The inlet 12*h* draws in a refrigerant gas, which is a fluid.

The motor housing member 12 includes a cylindrical boss 12*d*. The boss 12*d* protrudes from the inner wall of the end wall 12*a*. The rotary shaft 15 includes a first end portion, which is one end portion in the axial direction, and a second end portion, which is the other end portion in the axial direction. The first end portion of the rotary shaft 15 is inserted into the boss 12*d*. The scroll compressor 10 includes a rolling-element bearing 16. The rolling-element bearing 16 is disposed between the inner circumferential surface of the boss 12*d* and the outer circumferential surface of the first end portion of the rotary shaft 15. The first end portion of the rotary shaft 15 is rotatably supported by the motor housing member 12 with the rolling-element bearing 16.

The shaft support housing member 13 includes a disc-shaped end wall 17 and a tubular peripheral wall 18. The peripheral wall 18 tubularly extends from the outer periphery of the end wall 17. The axial direction of the peripheral wall 18 agrees with the axial direction of the rotary shaft 15. The shaft support housing member 13 includes an annular flange wall 19. The flange wall 19 extends outward in the radial direction of the rotary shaft 15 from an end portion of the outer circumferential surface of the peripheral wall 18. Specifically, the flange wall 19 extends from an end portion that is on the side opposite to the end wall 17. The outer periphery of the flange wall 19 is in contact with an opening end of the peripheral wall 12*b* of the motor housing member 12.

The shaft support housing member 13 includes an insertion hole 17*a*. The insertion hole 17*a* is formed at the center of the end wall 17. The insertion hole 17*a* extends through the end wall 17 in the thickness direction. The rotary shaft 15 extends through the insertion hole 17*a*. The rotary shaft 15 includes an end face 15*e* in the second end portion. The end face 15*e* is located on the inner side of the peripheral wall 18. The scroll compressor 10 includes a rolling-element bearing 21. The rolling-element bearing 21 is disposed between the inner circumferential surface of the peripheral wall 18 and the outer circumferential surface of the rotary shaft 15. The rotary shaft 15 is rotatably supported by the shaft support housing member 13 with the rolling-element bearing 21. The rotary shaft 15 is thus rotatably supported by the housing 11.

The housing 11 includes a motor chamber S1. The motor chamber S1 is defined by the motor housing member 12 and the shaft support housing member 13. The motor chamber S1 is connected to the inlet 12*h*. Refrigerant gas is drawn into the motor chamber S1 through the inlet 12*h*.

The scroll compressor 10 includes an electric motor 22. The electric motor 22 is accommodated in the motor chamber S1. The electric motor 22 includes a tubular stator 23 and a tubular rotor 24. The rotor 24 is located on the inner side of the stator 23. The rotor 24 rotates integrally with the rotary shaft 15. The stator 23 surrounds the rotor 24. The rotor 24 includes a rotor core 24*a*, which is fixed to the rotary shaft 15, and permanent magnets (not shown), which are provided on the rotor core 24*a*. The stator 23 includes a tubular stator core 23*a* and a coil 23*b*. The stator core 23*a* is fixed to the inner circumferential surface of the peripheral wall 12*b* of the motor housing member 12. The coil 23*b* is wound about the stator core 23*a*. When power that is controlled by an inverter (not shown) is supplied to the coil 23*b*, the rotor 24 rotates. Accordingly, the rotary shaft 15 rotates integrally with the rotor 24

The discharge housing member 14 includes a plate-shaped end wall 14*a* and a tubular peripheral wall 14*b*. The peripheral wall 14*b* tubularly extends from the outer periphery of the end wall 14*a*. The axial direction of the peripheral wall 14*b* agrees with the axial direction of the rotary shaft 15. The peripheral wall 14*b* includes an opening end that is in contact with the outer periphery of the flange wall 19.

The discharge housing member 14, the shaft support housing member 13, and the motor housing member 12 are fixed to each other with bolts B1. The bolts B1 extend through the peripheral wall 14*b* of the discharge housing member 14 and the outer periphery of the flange wall 19 so as to be threaded into the peripheral wall 12*b* of the motor housing member 12. This couples the shaft support housing member 13 to the peripheral wall 12*b* of the motor housing member 12, and couples the discharge housing member 14 to the flange wall 19 of the shaft support housing member 13. Accordingly, the motor housing member 12, the shaft support housing member 13, and the discharge housing member 14 are arranged in that order in the axial direction of the rotary shaft 15.

The scroll compressor 10 includes a discharge chamber S2. The discharge chamber S2 is formed in the discharge housing member 14. The discharge housing member 14 includes an outlet 14*h*. The outlet 14*h* is formed in the end wall 14*a* of the discharge housing member 14. The outlet 14*h* is connected to the discharge chamber S2. The outlet 14*h* discharges refrigerant gas in the discharge chamber S2.

The outlet 14*h* is connected to the inlet 12*h* by an external refrigerant circuit 20. The external refrigerant circuit 20 includes a condenser, an expansion valve, and an evaporator, none of which is shown. Refrigerant gas that is discharged from the outlet 14*h* flows through the external refrigerant circuit 20. The refrigerant gas in the external refrigerant circuit 20 flows through the condenser, the expansion valve, and the evaporator to return to the motor chamber S1 via the inlet 12*h*. The scroll compressor 10 and the external refrigerant circuit 20 form the vehicle air conditioner.

The scroll compressor 10 includes a fixed scroll 25 and an orbiting scroll 26. The fixed scroll 25 and the orbiting scroll 26 are arranged on the inner side of the peripheral wall 14*b* of the discharge housing member 14. The fixed scroll 25 is located between the orbiting scroll 26 and the end wall 14*a* in the axial direction of the rotary shaft 15.

Figure 2:
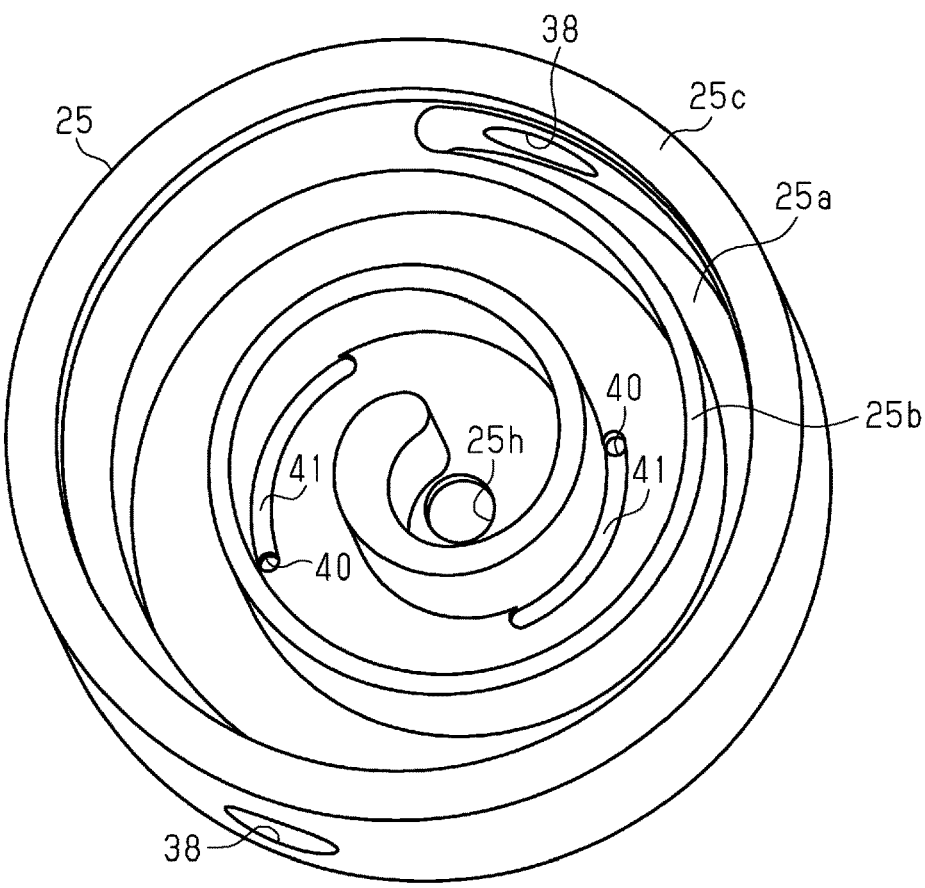
FIG. 2 is a perspective view of a fixed scroll.

As shown in FIGS. 1 and 2, the fixed scroll 25 includes a fixed base plate 25*a* and a fixed volute wall 25*b*. The fixed base plate 25*a* has the shape of a disc. The fixed volute wall 25*b* extends from the fixed base plate 25*a* in a direction away from the end wall 14*a*. The fixed scroll 25 includes a fixed outer peripheral wall 25*c*. The fixed outer peripheral wall 25*c* protrudes cylindrically from the outer periphery of the fixed base plate 25*a*. The fixed outer peripheral wall 25*c* surrounds the fixed volute wall 25*b*. The measurement from the fixed base plate 25*a* to the opening end face of the fixed outer peripheral wall 25*c* is greater than the measurement from the fixed base plate 25*a* to the distal end face of the fixed volute wall 25*b*.

As shown in FIG. 1, the orbiting scroll 26 includes an orbiting base plate 26*a* and an orbiting volute wall 26*b*. The orbiting base plate 26*a* has the shape of a disc. The orbiting base plate 26*a* faces the fixed base plate 25*a*. The orbiting volute wall 26*b* extends from the orbiting base plate 26*a* toward the fixed base plate 25*a*. The orbiting volute wall 26*b* meshes with the fixed volute wall 25*b*. The orbiting volute wall 26*b* is located on the inner side of the fixed outer peripheral wall 25*c*. The distal end face of the fixed volute wall 25*b* is in contact with the orbiting base plate 26*a*. The distal end face of the orbiting volute wall 26*b* is in contact with the fixed base plate 25*a*. The fixed base plate 25*a*, the fixed volute wall 25*b*, the orbiting base plate 26*a*, and the orbiting volute wall 26*b* define compression chambers 27. In other words, the fixed scroll 25 and the orbiting scroll 26 define the compression chambers 27. Each compression chamber 27 compresses refrigerant gas.

The fixed base plate 25*a* and the orbiting base plate 26*a* have volute wall forming surfaces provided with the corresponding volute walls. The volute wall forming surfaces are compression chamber defining surfaces, which define compression chambers.

The orbiting scroll 26 includes a cylindrical boss 26*c*. The orbiting base plate 26*a* includes an end face 26*e* on a side opposite to the fixed base plate 25*a*, and the boss 26*c* protrudes from the end face 26*e*. The axial direction of the boss 26*c* agrees with the axial direction of the rotary shaft 15.

The orbiting scroll 26 includes recesses 26*d*. The recesses 26*d* are formed around the boss 26*c* in the end face 26*e* of the orbiting base plate 26*a*. The recesses 26*d* are arranged at predetermined intervals in the circumferential direction of the rotary shaft 15. For illustrative purposes, only one of the recesses 26*d* is illustrated in FIG. 1. An annular ring member 28 is fitted in each of the recesses 26*d*. The scroll compressor 10 includes pins 29. The pins 29 are provided on the shaft support housing member 13. The pins 29 protrudes from end face 13*e* of the shaft support housing member 13 that faces the discharge housing member 14. The pins 29 are respectively inserted into the ring members 28.

The scroll compressor 10 includes an eccentric shaft 31. The eccentric shaft 31 protrudes toward the orbiting scroll 26 from a part of the end face 15*e* of the rotary shaft 15 that is eccentric from an axis L1 of the rotary shaft 15. The eccentric shaft 31 is formed integrally with the rotary shaft 15. The axial direction of the eccentric shaft 31 agrees with the axial direction of the rotary shaft 15. The eccentric shaft 31 is inserted into the boss 26*c*.

The scroll compressor 10 includes a balance weight 32 and a bushing 33. The balance weight 32 is integrated with the bushing 33. The bushing 33 is fitted about the outer circumferential surface of the eccentric shaft 31. The balance weight 32 is formed integrally with the bushing 33. The balance weight 32 is accommodated inside the peripheral wall 18 of the shaft support housing member 13. The orbiting scroll 26 is supported by the eccentric shaft 31 with the bushing 33 and the rolling-element bearing 34 so as to be rotatable relative to the eccentric shaft 31.

Rotation of the rotary shaft 15 is transmitted to the orbiting scroll 26 via the eccentric shaft 31, the bushing 33, and the rolling-element bearing 34. This causes the orbiting scroll 26 to orbit. Specifically, contact between the pins 29 and the inner circumferential surfaces of the respective ring members 28 prevents the orbiting scroll 26 from rotating and only allows the orbiting scroll 26 to orbit. As a result, the orbiting scroll 26 orbits with the orbiting volute wall 26*b* being in contact with the fixed volute wall 25*b*, and the volume of each compression chamber 27 decreases to compress refrigerant gas. In short, the orbiting scroll 26 orbits as the rotary shaft 15 rotates. The balance weight 32 cancels out the centrifugal force acting on the orbiting scroll 26 when the orbiting scroll 26 orbits, thereby reducing the amount of imbalance of the orbiting scroll 26.

The scroll compressor 10 includes one or more first grooves 35, one or more first holes 36, and one or more second grooves 37. The first grooves 35 are formed in the inner circumferential surface of the peripheral wall 12*b* of the motor housing member 12. The first grooves 35 open in the opening end of the peripheral wall 12*b*. The first holes 36 are formed in the outer periphery of the flange wall 19 of the shaft support housing member 13. The first holes 36 extend through the flange wall 19 in the thickness direction. Each first hole 36 is connected to the corresponding one of the first grooves 35. The second grooves 37 are formed in the inner circumferential surface of the peripheral wall 14*b* of the discharge housing member 14. Each second groove 37 is connected to the corresponding one of the first holes 36. For the illustrative purposes, one of the first grooves 35, one of the first holes 36, and one of the second groove 37 are shown in FIG. 1.

As shown in FIGS. 1 and 2, the fixed scroll 25 includes two suction ports 38. The suction ports 38 are formed in the fixed outer peripheral wall 25*c* of the fixed scroll 25. Each suction port 38 extends through the fixed outer peripheral wall 25*c* in the thickness direction. Each suction ports 38 is connected to the corresponding one of the second grooves 37. The suction ports 38 are arranged, for example, at positions separated by 180° in the circumferential direction of the fixed outer peripheral wall 25*c*.

As shown in FIG. 1, the scroll compressor 10 includes a suction chamber 39. The suction chamber 39 is connected to the two suction ports 38. The suction chamber 39 is formed on the inner side of the fixed outer peripheral wall 25*c*. The suction chamber 39 is part of the space on the inner side of the fixed outer peripheral wall 25*c* and is connected to at least one of the two suction ports 38 as the orbiting scroll 26 orbits. Depending on the position of the orbiting scroll 26, the suction chamber 39 is connected to one of the two suction ports 38 while being disconnected from the other suction port 38. Further, depending on the position of the orbiting scroll 26, the suction chamber 39 is connected to both of the two suction ports 38.

The refrigerant gas in the motor chamber S1 is drawn into the suction chamber 39 through the first grooves 35, the first holes 36, the second grooves 37, and the suction ports 38. The refrigerant gas drawn into the suction chamber 39 is compressed in the compression chambers 27 through the orbital motion of the orbiting scroll 26.

The housing 11 includes a back pressure chamber S3. The back pressure chamber S3 is located on the inner side of the peripheral wall 18 of the shaft support housing member 13. Thus, the back pressure chamber S3 is formed at a position in the housing 11 that is on the opposite side of the orbiting base plate 26*a* from the fixed base plate 25*a*. The shaft support housing member 13 defines the back pressure chamber S3 and the motor chamber S1.

The orbiting scroll 26 includes a back pressure introducing passage 26*f*. The back pressure introducing passage 26*f* extends through the orbiting base plate 26*a* and the orbiting volute wall 26*b*. The back pressure introducing passage 26*f* introduces some of the refrigerant gas in the compression chambers 27 into the back pressure chamber S3. Since some of the refrigerant gas in the compression chambers 27 is introduced to the back pressure chamber S3 via the back pressure introducing passage 26*f*, the pressure in the back pressure chamber S3 is greater than the pressure in the motor chamber S1. The relatively high pressure in the back pressure chamber S3 urges the orbiting scroll 26 toward the fixed scroll 25, so that the distal end face of the orbiting volute wall 26*b* is pressed against the fixed base plate 25*a*.

<Main Discharge Port 25*h*>

As shown in FIGS. 1 and 2, the fixed base plate 25*a* includes a main discharge port 25*h* at the center. The main discharge port 25*h* is a circular hole. The main discharge port 25*h* extends through the fixed base plate 25*a* in the thickness direction. The main discharge port 25*h* includes a first end connected to the compression chambers 27. The main discharge port 25*h* includes a second end connected to the discharge chamber S2. The main discharge port 25*h* discharges the refrigerant gas compressed in the compression chambers 27 to the discharge chamber S2.

<Auxiliary Discharge Ports 40>

The fixed base plate 25*a* includes one or more auxiliary discharge ports 40. The fixed base plate 25*a* is therefore a base plate in which one or more auxiliary discharge ports 40 are formed. The fixed volute wall 25*b* is a volute wall that extends from a base plate in which one or more auxiliary discharge ports 40 are formed. As shown in FIG. 2, the scroll compressor 10 includes two auxiliary discharge ports 40. The two auxiliary discharge ports 40 are provided on opposite sides of the main discharge port 25*h*. The auxiliary discharge ports 40 are thus arranged at positions different from the main discharge port 25*h*. In the present embodiment, there is no need to design a volute wall to be wider than that in a case in which auxiliary discharge ports are formed in a volute wall. This configuration prevents the volume of each compression chamber 27 from decreasing and prevents the size of the scroll compressor 10 from increasing.

Each auxiliary discharge port 40 is a circular hole. Each auxiliary discharge port 40 extends through the fixed base plate 25*a* in the thickness direction. As shown in FIG. 1, each auxiliary discharge port 40 includes a first end connected to one of the compression chambers 27. Each auxiliary discharge port 40 includes a second end connected to the discharge chamber S2. The diameter of the auxiliary discharge ports 40 is smaller than the width of the orbiting volute wall 26*b*. When the orbiting scroll 26 orbits, the orbiting volute wall 26*b* overlaps with the auxiliary discharge ports 40. Therefore, when the orbiting scroll 26 orbits and the orbiting volute wall 26*b* overlaps with the auxiliary discharge ports 40, the orbiting volute wall 26*b* covers the auxiliary discharge ports 40. Each auxiliary discharge port 40 discharges the refrigerant gas in a compression chamber 27 when the pressure in the compression chamber 27 becomes greater than or equal to a preset pressure.

<Grooves 41>

As shown in FIG. 2, the fixed base plate 25*a* includes grooves 41. In the present embodiment, the auxiliary discharge ports 40 and the grooves 41 are formed in the fixed base plate 25*a*. The grooves 41 are formed in the fixed base plate 25*a* so as to be respectively connected to the auxiliary discharge ports 40. The volute wall forming surface of the fixed base plate 25*a* includes openings of the auxiliary discharge ports 40 and the grooves 41 connected to the openings. The grooves 41 are connected to the openings of the auxiliary discharge ports 40, which open to the compression chambers 27. Each groove 41 has a curved shape extending along the fixed volute wall 25*b*. A state in which each groove 41 extends along the fixed volute wall 25*b* refers to a state in which each groove 41 extends along the shape of the fixed volute wall 25*b* while being located in the vicinity of the fixed volute wall 25*b*. Each groove 41 arcuately extends along the fixed volute wall 25*b* from the corresponding the auxiliary discharge port 40. Each auxiliary discharge port 40 is connected to a first end in the extending direction of the corresponding groove 41. The width of the grooves 41 is the same as the diameter of the auxiliary discharge ports 40. The width of the grooves 41 is smaller than the width of the orbiting volute wall 26*b*. Accordingly, the width of each groove 41 is smaller than the width of the orbiting volute wall 26*b*, which is a volute wall overlapping with the auxiliary discharge ports 40.

Each groove 41 is located on the path of the orbiting volute wall 26*b* when the orbiting scroll 26 is orbiting. When the orbiting scroll 26 orbits and the orbiting volute wall 26*b* overlaps with the grooves 41, the orbiting volute wall 26*b* partially covers the grooves 41. Each groove 41 is always connected to one of the compression chambers 27 and is partially covered with the orbiting volute wall 26*b*, which is a volute wall facing the groove 41, so that the compression chamber 27 that is in a compression process and is connected to the auxiliary discharge port 40 corresponding to the groove 41 is not connected to other compression chambers 27 in a compression process or to the compression chamber 27 connected to the main discharge port 25*h*. That is, each groove 41 satisfies all the following conditions.

First Condition: The groove 41 is partially covered with the orbiting volute wall 26*b*, which is a volute wall facing the groove 41, so that the compression chamber 27 that is in a compression process and is connected to the auxiliary discharge port 40 connected to the groove 41 is not connected to other compression chambers 27 in a compression process.

Second Condition: The groove 41 is partially covered with the orbiting volute wall 26*b*, which is a volute wall facing the groove 41, so that the compression chamber 27 that is in a compression process and is connected to the auxiliary discharge port 40 connected to the groove 41 is not connected to the compression chamber 27 connected to the main discharge port 25*h*.

Third Condition: Each groove 41 is always connected to one of the compression chambers 27.

Each auxiliary discharge port 40 is connected to a compression chamber 27 from a time at which compression of refrigerant gas is started in the compression chamber 27.

<Reed Valve 51>

Figure 3:
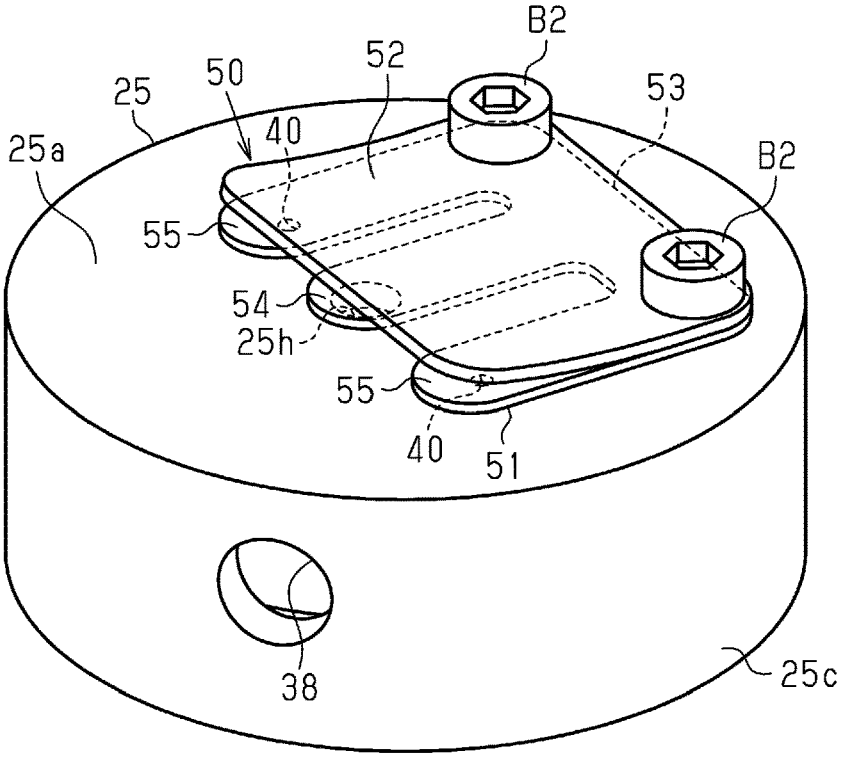
FIG. 3 is a perspective view showing a fixed scroll and a reed valve.

As shown in FIG. 3, the scroll compressor 10 includes a valve mechanism 50. The valve mechanism 50 is provided on a surface of the fixed base plate 25*a* that is on a side opposite to the fixed volute wall 25*b*. The valve mechanism 50 includes a reed valve 51 and a retainer 52. The reed valve 51 is thus provided on a surface of the fixed base plate 25*a* that is on the side opposite to the volute wall forming surfaces.

The reed valve 51 is an elastically deformable thin plate. The reed valve 51 is a metal plate. The reed valve 51 includes an attaching portion 53, a main valve member 54, and two auxiliary valve members 55. The attaching portion 53, the main valve member 54, and the two auxiliary valve members 55 are formed integrally by a single metal plate.

The attaching portion 53 has the shape of an elongated rectangular plate. The main valve member 54 and the two auxiliary valve members 55 each have the shape of an elongated rectangular plate. The main valve member 54 and the two auxiliary valve members 55 extend from the attaching portion 53 in a state in which their longitudinal directions agree with each other. The longitudinal direction of the main valve member 54 and the two auxiliary valve members 55 is orthogonal to the longitudinal direction of the attaching portion 53.

The main valve member 54 extends from the attaching portion 53 to the main discharge port 25*h*. The distal end portion of the main valve member 54 covers the main discharge port 25*h*. Each auxiliary valve member 55 extends from the attaching portion 53 toward the corresponding auxiliary discharge port 40. The distal end portions of the auxiliary valve members 55 respectively cover the auxiliary discharge ports 40.

The retainer 52 is a plate thicker than the reed valve 51. The retainer 52 and the reed valve 51 are attached to the fixed base plate 25*a* by threading bolts B2, which extend through the retainer 52 and attaching portion 53 of the reed valves 51, into the fixed base plate 25*a*. The retainer 52 is bent so as to be gradually separated from the fixed base plate 25*a* from the attaching portion 53 toward the distal ends of the main valve member 54 and the auxiliary valve members 55. This allows the main valve member 54 and the auxiliary valve members 55 to swing about the ends connected to the attaching portion 53 in directions toward and away from the fixed base plate 25*a*.

The reed valve 51 opens the main discharge port 25*h* when the main valve member 54 swings in a direction away from the fixed base plate 25*a* from a state in which the main valve member 54 closes the main discharge port 25*h*. The reed valve 51 opens each auxiliary discharge port 40 when the corresponding auxiliary valve member 55 swings in a direction away from the fixed base plate 25*a* from a state in which the auxiliary valve member 55 closes the auxiliary discharge port 40. The retainer 52 regulates the opening degrees of the main valve member 54 and the two auxiliary valve members 55. In this manner, the reed valve 51 opens and closes the main discharge port 25*h* and the auxiliary discharge ports 40.

The refrigerant gas that is compressed in the compression chambers 27 and discharged from the main discharge port 25*h* is discharged from the main discharge port 25*h* to the discharge chamber S2 by flexing the main valve member 54. The refrigerant gas discharged from each of the auxiliary discharge ports 40 when the pressure in the compression chambers 27 is greater than or equal to the preset pressure is discharged from the auxiliary discharge ports 40 to the discharge chamber S2 by flexing the auxiliary valve members 55.

Operation of Embodiment

Operation of the present embodiment will now be described.

Figure 16:
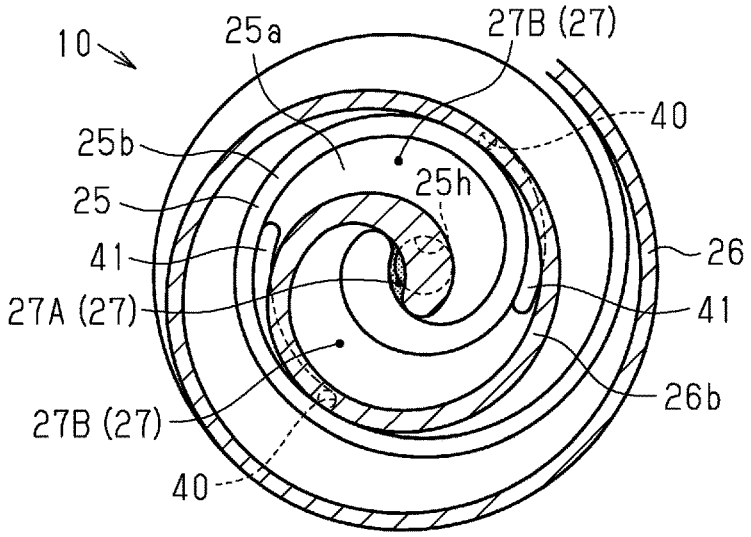
FIG. 16 is a cross-sectional view showing the fixed scroll and the orbiting scroll.
Figure 17:
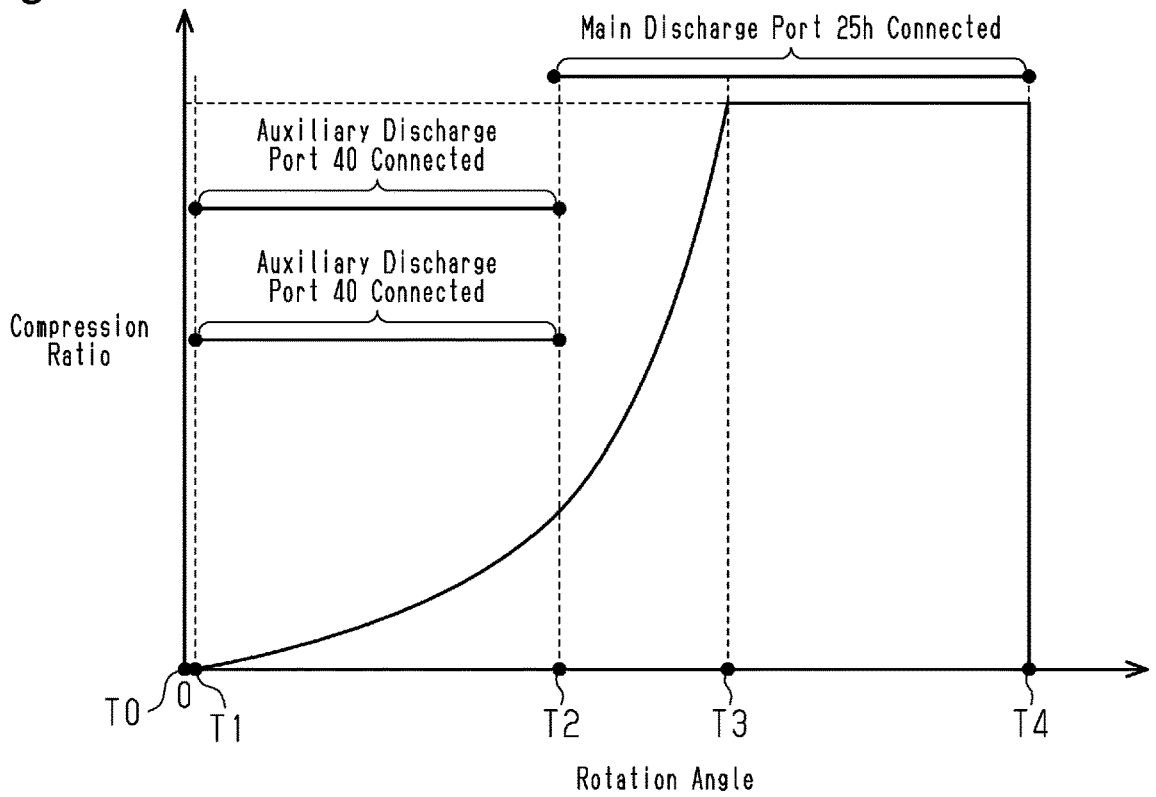
FIG. 17 is a graph showing a relationship between a rotation angle and a compression ratio.

FIGS. 4 to 16 show changes in the volume of each compression chamber 27 caused by an orbital motion of the orbiting scroll 26. FIG. 17 shows a relationship between the rotation angle and the compression ratio of the compression chambers 27 that are depicted with stippling in FIGS. 4 to 16. In the section of [Operation of Embodiment], the compression chambers 27 depicted with stippling are simply referred to as compression chambers 27A in some cases. Also, in the section of [Operation of Embodiment], the compression chambers 27 depicted as blank areas are simply referred to as compression chambers 27B in some cases.

Figure 4:
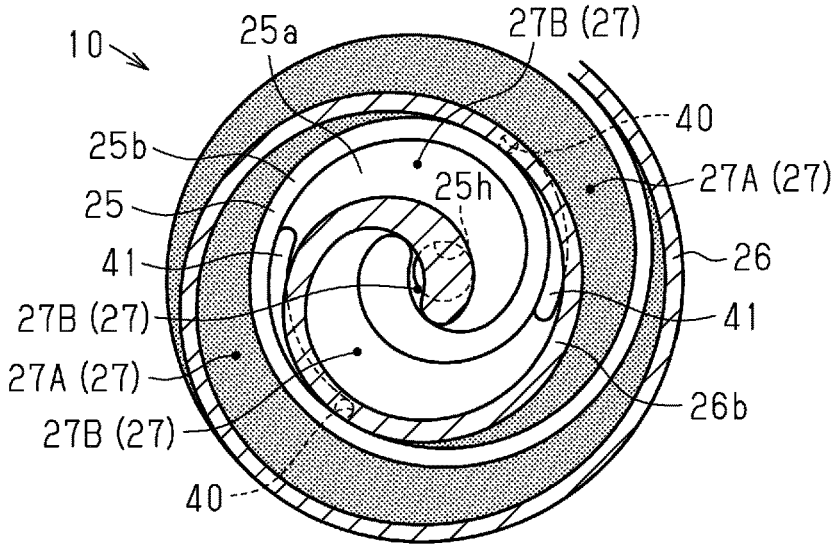
FIG. 4 is a cross-sectional view showing the fixed scroll and an orbiting scroll.

FIG. 4 shows a state at time T0, at which the suction chamber 39, into which refrigerant gas has been drawn from the suction ports 38, is divided into the two compression chambers 27A due to the orbital motion of the orbiting scroll 26. At time T0, the compression chambers 27A are in a state immediately before the refrigerant gas starts to be compressed, and the compression ratio of the compression chambers 27A is therefore 0 as shown in FIG. 17.

Figure 5:
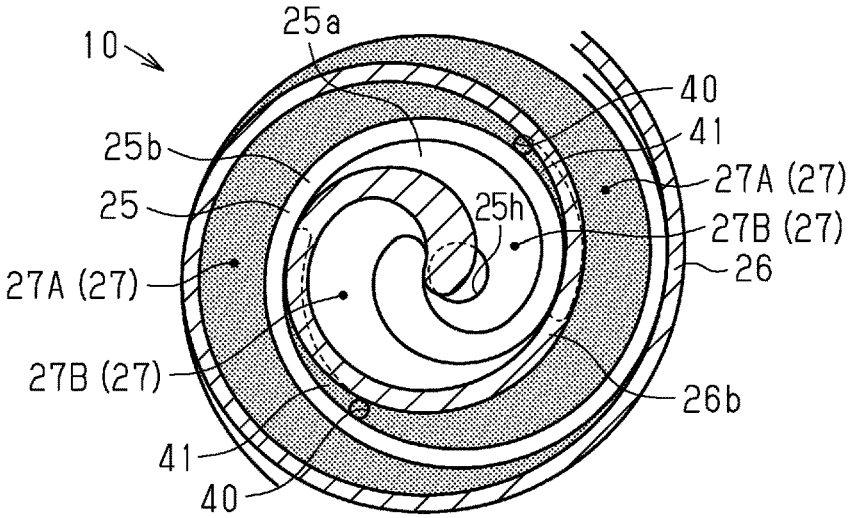
FIG. 5 is a cross-sectional view showing the fixed scroll and the orbiting scroll.

FIG. 5 illustrates a state at time T1, at which the refrigerant gas starts being compressed in the compression chambers 27A. As shown in FIG. 5, the auxiliary discharge ports 40 are each connected to a compression chamber 27 at time T1. Accordingly, each auxiliary discharge port 40 is connected to one of the compression chambers 27A from the time at which compression of the refrigerant gas is started in the compression chamber 27A. At this time, the grooves 41 are not connected to the compression chambers 27B. Therefore, each groove 41 is partially covered with the orbiting volute wall 26*b*, so that the compression chamber 27A that is in a compression process and is connected to the auxiliary discharge port 40 corresponding to the groove 41 is not connected to the compression chamber 27B in a compression process or to the compression chamber 27B connected to the main discharge port 25*h*.

Figure 6:
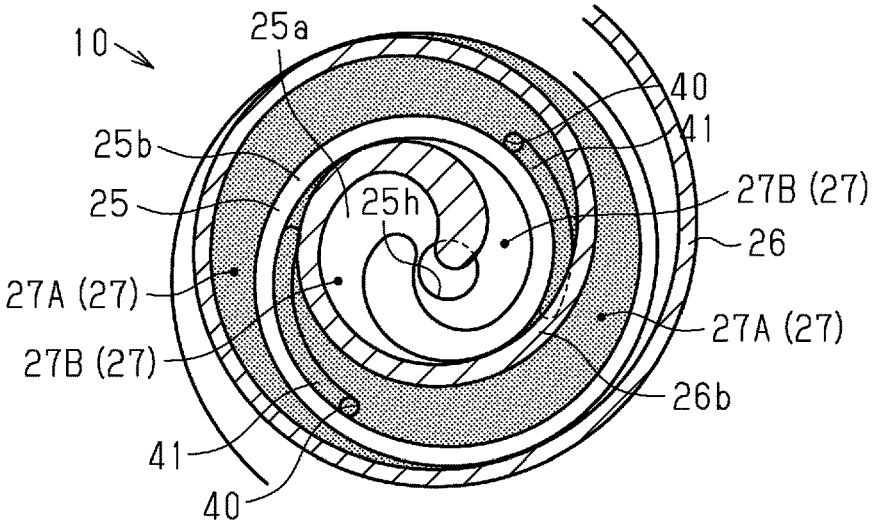
FIG. 6 is a cross-sectional view showing the fixed scroll and the orbiting scroll.
Figure 7:
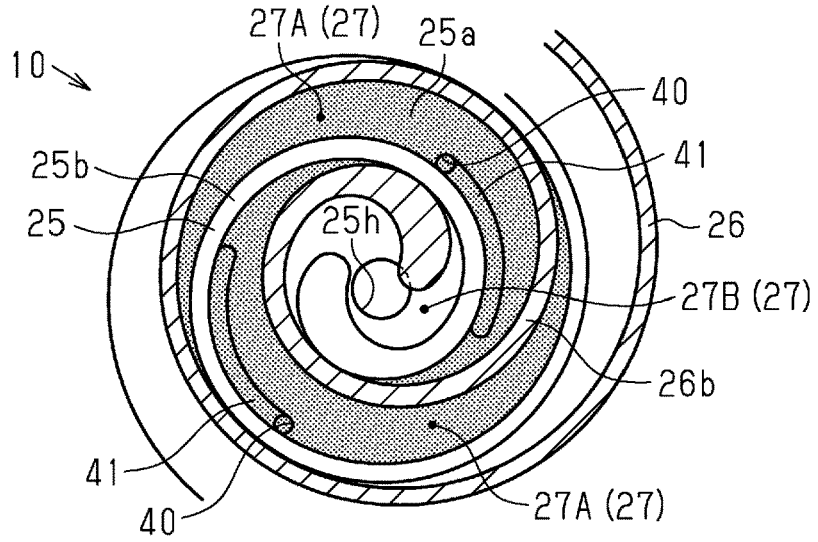
FIG. 7 is a cross-sectional view showing the fixed scroll and the orbiting scroll.
Figure 8:
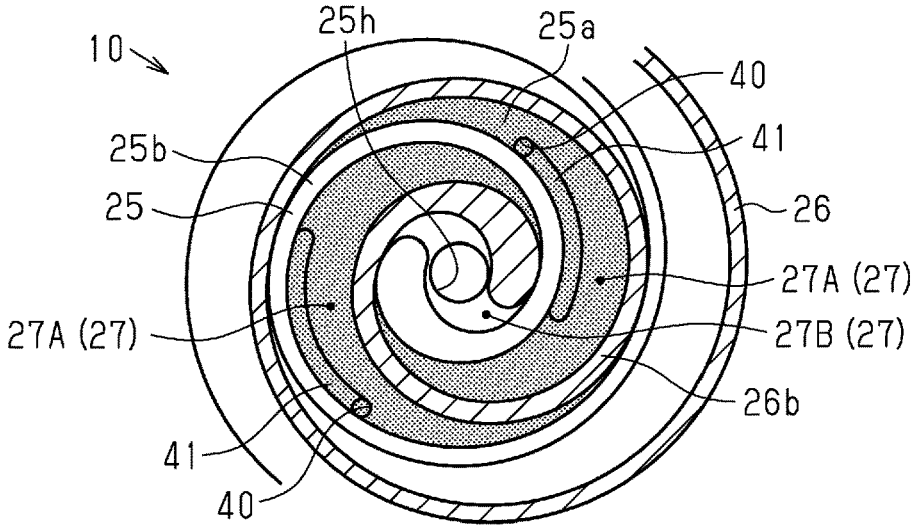
FIG. 8 is a cross-sectional view showing the fixed scroll and the orbiting scroll.

As shown in FIGS. 6 to 8, the volume of each compression chamber 27A decreases as the orbital motion of the orbiting scroll 26 progresses. Accordingly, the compression ratio of each compression chamber 27A gradually increases as shown in FIG. 17. In addition, as shown in FIGS. 6 to 8, as the orbital motion of the orbiting scroll 26 progresses, the area of each groove 41 connected to the corresponding compression chamber 27A gradually increases.

Figure 9:
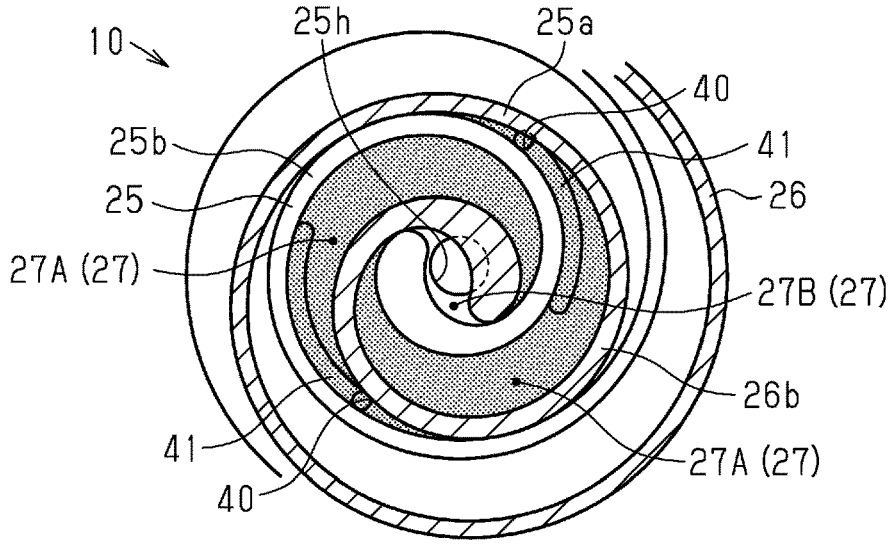
FIG. 9 is a cross-sectional view showing the fixed scroll and the orbiting scroll.
Figure 10:
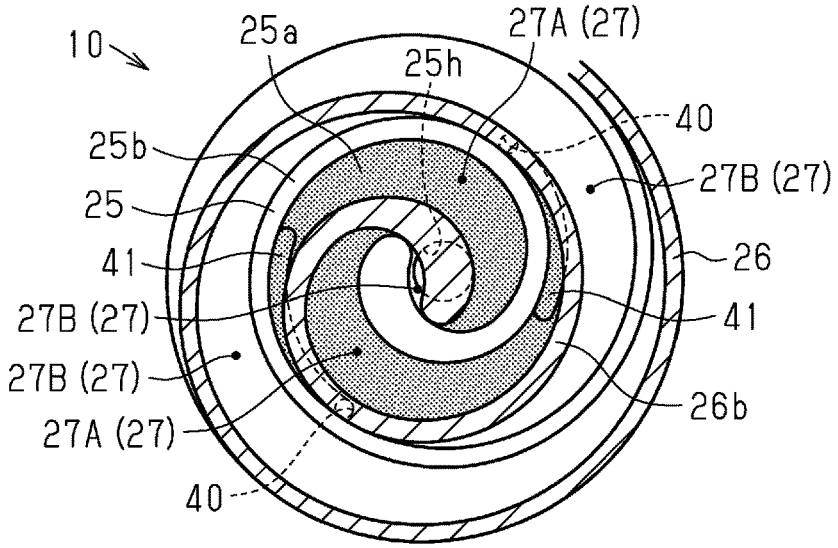
FIG. 10 is a cross-sectional view showing the fixed scroll and the orbiting scroll.

When the volume of each compression chamber 27A further decreases from the state shown in FIG. 8 as the orbital motion of the orbiting scroll 26 progresses, each auxiliary discharge port 40 starts to overlap with the orbiting volute wall 26*b* as shown in FIG. 9. When the orbiting scroll 26 further orbits from the state shown in FIG. 9, the orbiting volute wall 26*b* covers the auxiliary discharge ports 40 as shown in FIG. 10. At this time, the end portion of each groove 41 on the side opposite to the auxiliary discharge port 40 continues to be connected to the corresponding compression chamber 27A. Therefore, each auxiliary discharge port 40 continues to be connected to the corresponding compression chamber 27A via the groove 41. In the states shown in FIGS. 4 to 10, each compression chamber 27A is not connected to the main discharge port 25*h*, and each compression chamber 27B is connected to the main discharge port 25*h*.

Figure 11:
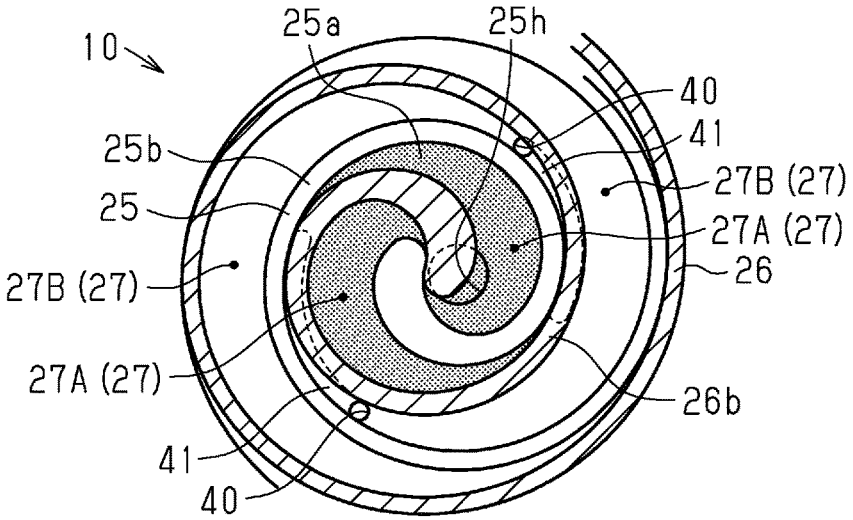
FIG. 11 is a cross-sectional view showing the fixed scroll and the orbiting scroll.

When the volume of each compression chamber 27A further decreases from the state shown in FIG. 10 as the orbital motion of the orbiting scroll 26 progresses, the end portion of each groove 41 on the side opposite to the auxiliary discharge port 40 is covered with the orbiting volute wall 26*b* as shown in FIG. 11. This disconnects the grooves 41 and the compression chambers 27A from each other. Accordingly, the auxiliary discharge ports 40 and the compression chambers 27A are disconnected from each other. Then, at time T2, at which the auxiliary discharge ports 40 and the compression chambers 27A are disconnected from each other, one of the two compression chambers 27A and the main discharge port 25*h* start being connected to each other. On the other hand, the auxiliary discharge ports 40 are respectively connected to the compression chambers 27B at time T2. Each auxiliary discharge port 40 is connected to the corresponding compression chamber 27B from the time at which compression of the refrigerant gas is started in the compression chamber 27B.

Figure 12:
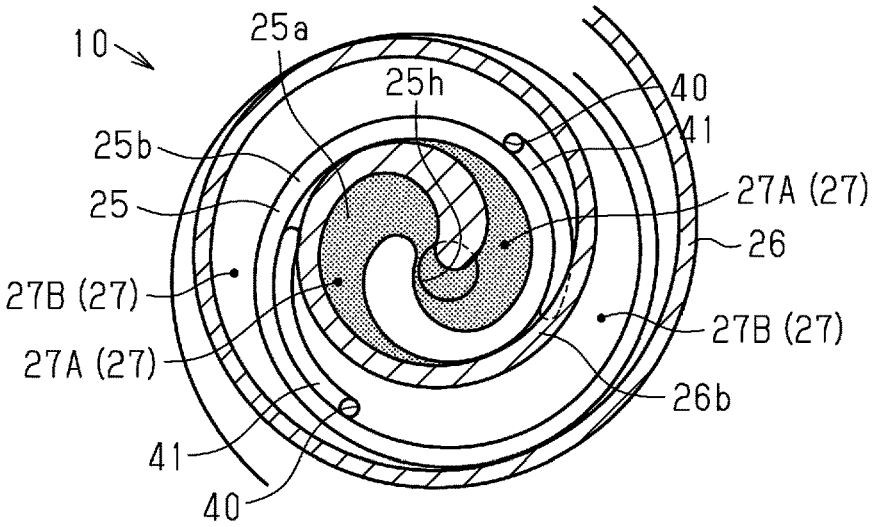
FIG. 12 is a cross-sectional view showing the fixed scroll and the orbiting scroll.
Figure 13:
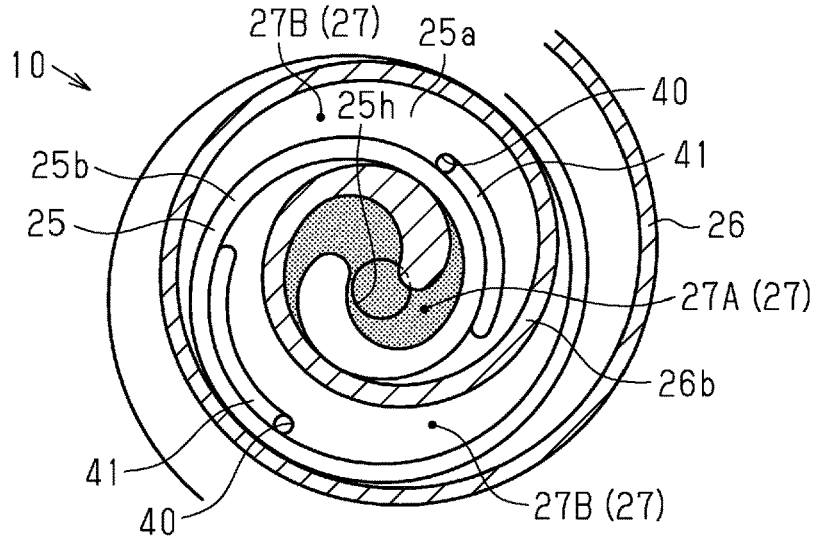
FIG. 13 is a cross-sectional view showing the fixed scroll and the orbiting scroll.
Figure 14:
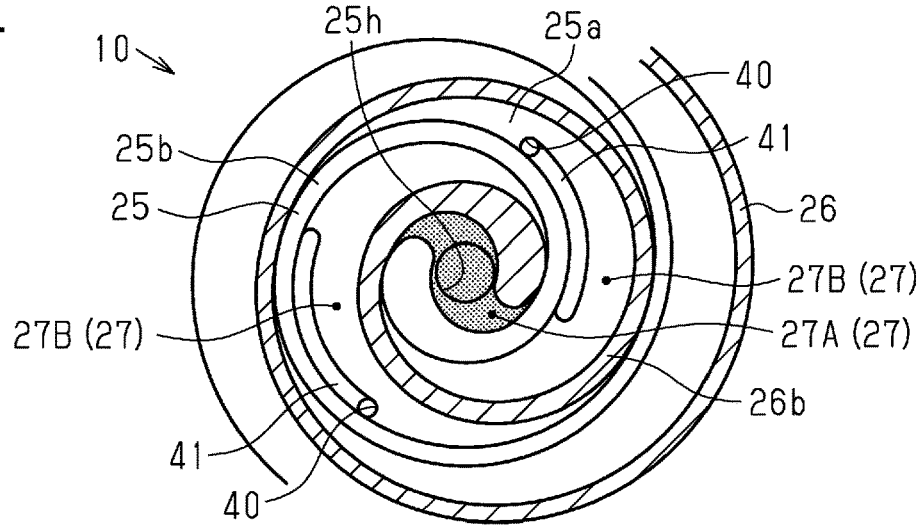
FIG. 14 is a cross-sectional view showing the fixed scroll and the orbiting scroll.
Figure 15:
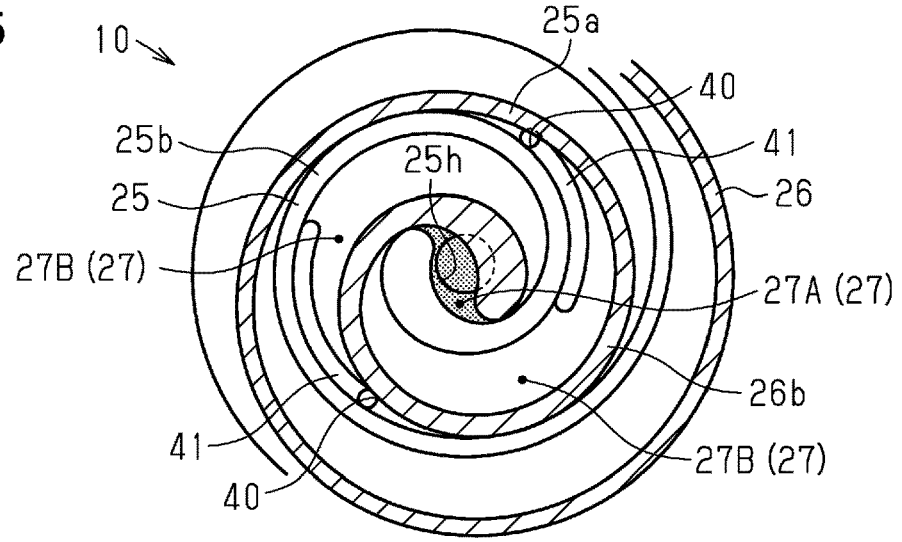
FIG. 15 is a cross-sectional view showing the fixed scroll and the orbiting scroll.

When the orbiting scroll 26 further orbits from the state shown in FIG. 11, the two compression chambers 27A are connected to the main discharge port 25*h* as shown in FIGS. 12 and 13. Then the two compression chambers 27A are connected to each other as shown in FIG. 13. Further, as shown in FIGS. 13 to 16, the volume of the compression chamber 27A gradually decreases as the orbital motion of the orbiting scroll 26 progresses, and the refrigerant gas in the compression chamber 27A is discharged to the discharge chamber S2 via the main discharge port 25*h*. As shown in FIG. 17, the compression ratio of the compression chamber 27A becomes constant from time T3, at which the main valve member 54 of the reed valve 51 opens. Then, the main valve member 54 of the reed valve 51 is closed and the compression ratio of the compression chambers 27 becomes 0 at time T4, at which the volume of the compression chamber 27A becomes minimum as shown in FIG. 16 and the main discharge port 25*h* is covered with the orbiting volute wall 26*b*. In the states shown in FIGS. 12 to 16, the grooves 41 are connected to the compression chambers 27B. As shown in FIG. 17, each compression chamber 27 is connected to either an auxiliary discharge port 40 or the main discharge port 25*h* in the operation range of the scroll compressor 10.

In this manner, each auxiliary discharge port 40 is always connected to one of the compression chambers 27 via the corresponding groove 41. This configuration reduces an operation range in which the auxiliary discharge ports 40 are not connected to the compression chambers 27, as compared with a case in which the grooves 41 are not formed in the fixed base plate 25*a*. Therefore, the refrigerant gas is discharged from each auxiliary discharge port 40 in a wider operation range. As a result, the operation range is reduced in which the refrigerant gas cannot be discharged from each auxiliary discharge port 40. This reduces the operation range in which the pressure in each compression chamber 27 becomes abnormally high.

Each auxiliary discharge port 40 is connected to a compression chamber 27 from a time at which compression of refrigerant gas is started in the compression chamber 27. Therefore, for example, even if liquid refrigerant is drawn into a compression chamber 27, the liquid refrigerant is discharged from an auxiliary discharge port 40 from the time at which the compression process of refrigerant gas is started in the compression chamber 27. Therefore, the occurrence of liquid compression in the compression chambers 27 is readily avoided.

Advantages of Embodiment

The above-described embodiment has the following advantages.

(1) Each groove 41 is partially covered with the orbiting volute wall 26*b*, which faces the groove 41, so that the compression chamber 27 that is connected to the auxiliary discharge port 40 corresponding to the groove 41 is not connected to other compression chambers 27 in a compression process or to the compression chamber 27 connected to the main discharge port 25*h*. Also, each groove 41 is always connected to one of the compression chambers 27. This configuration reduces the operation range in which the auxiliary discharge ports 40 are not connected to the compression chambers 27, as compared with a case in which the grooves 41 are not formed in the fixed base plate 25*a*, which includes the auxiliary discharge port 40. Therefore, the refrigerant gas is discharged from each auxiliary discharge port 40 in a wider operation range. As a result, the operation range is reduced in which the refrigerant gas cannot be discharged from each auxiliary discharge port 40. This reduces the operation range in which the pressure in each compression chamber 27 becomes abnormally high. Accordingly, the reliability of the scroll compressor 10 is improved.

(2) The width of each groove 41 is smaller than the width of the orbiting volute wall 26*b*, which overlaps with the auxiliary discharge ports 40. The orbiting volute wall 26*b* thus prevents each groove 41 from connecting a compression chamber 27 that is connected to an auxiliary discharge port 40 to another compression chamber 27 in the compression process or to the compression chamber 27 connected to the main discharge port 25*h*. This allows refrigerant gas to be compressed stably in each compression chamber 27, and therefore improves the reliability of the scroll compressor 10.

(3) Each auxiliary discharge port 40 is connected to a compression chamber 27 from a time at which compression of refrigerant gas is started in the compression chamber 27. With this configuration, for example, even if liquid refrigerant is drawn into a compression chamber 27, the liquid refrigerant is discharged from an auxiliary discharge port 40 from the time at which the compression process of refrigerant gas is started in the compression chamber 27. Therefore, the occurrence of liquid compression in the compression chambers 27 is readily avoided. This prevents the pressure in each compression chamber 27 from being abnormally high.

(4) The reed valve 51, which opens and closes the main discharge port 25*h* and the auxiliary discharge ports 40, is provided on the surface of the fixed base plate 25*a* opposite to the volute wall forming surface. The reed valve 51 prevents the refrigerant gas discharged from the main discharge port 25*h* and the auxiliary discharge ports 40 from flowing back to the main discharge port 25*h* and the auxiliary discharge ports 40. As described above, if the auxiliary discharge ports 40 are formed in the fixed base plate 25*a*, it is necessary to provide the reed valve 51, which opens and closes the main discharge port 25*h* and the auxiliary discharge ports 40, on the surface of the fixed base plate 25*a* opposite to the volute wall forming surfaces.

In order to reduce the operation range in which the auxiliary discharge ports 40 are not connected to compression chambers 27, the number of the auxiliary discharge ports 40 formed in the fixed base plate 25*a* may be increased without forming the grooves 41 in the fixed base plate 25*a*. However, such a configuration is not preferable since, as the number of the auxiliary discharge ports 40 formed in the fixed base plate 25*a* increases, the number of reed valves 51 for opening and closing the auxiliary discharge ports 40 increases or the shape of the reed valve 51 becomes complicated. Thus, the grooves 41 are formed in the fixed base plate 25*a*. This configuration reduces the operation range in which the auxiliary discharge ports 40 are not connected to compression chambers 27, while minimizing the number of the auxiliary discharge ports 40 formed in the fixed base plate 25*a*. Therefore, since the number of reed valves 51 does not increase or the shape of the reed valve 51 does not become complicated, the reliability of the scroll compressor 10 is improved with the simple structure of the scroll compressor 10.

(5) The scroll compressor 10 includes two auxiliary discharge ports 40. The two auxiliary discharge ports 40 are provided on opposite sides of the main discharge port 25*h*. The fixed base plate 25*a*, which includes the auxiliary discharge ports 40, further includes the grooves 41, which are respectively connected to the auxiliary discharge ports 40. This configuration further reduces the operation range in which refrigerant gas cannot be discharged from the auxiliary discharge ports 40, and thus further reduces the operation range in which the pressure in the compression chambers 27 becomes abnormally high. Accordingly, the reliability of the scroll compressor 10 is further improved.

(6) The auxiliary discharge ports 40 are formed in the fixed base plate 25*a*, and each groove 41 has a curved shape that extends along the fixed volute wall 25*b*, which extends from the fixed base plate 25*a*. The groove 41 is therefore suitable to be partially covered with the orbiting volute wall 26*b*, which faces the groove 41, and to be always connected to one of the compression chambers 27.

Modifications

The above-described embodiment may be modified as follows. The above-described embodiment and the following modifications can be combined as long as the combined modifications remain technically consistent with each other.

In the above-described embodiment, the auxiliary discharge ports 40 do not necessarily need to be formed in the fixed base plate 25*a*, but may be formed in the orbiting base plate 26*a*. In addition, the grooves 41 may be formed in the orbiting base plate 26*a*. In this case, when the orbiting scroll 26 orbits, the fixed volute wall 25*b* overlaps with the auxiliary discharge ports 40. Therefore, when the orbiting scroll 26 orbits and the fixed volute wall 25*b* overlaps with the auxiliary discharge ports 40, the fixed volute wall 25*b* covers the auxiliary discharge ports 40. The width of each groove 41 is smaller than the width of the fixed volute wall 25*b*, which is a volute wall overlapping with the auxiliary discharge ports 40. Each groove 41 is always connected to one of the compression chambers 27 and is partially covered with the fixed volute wall 25*b*, which is a volute wall facing the groove 41, so that the compression chamber 27 that is in a compression process and is connected to the auxiliary discharge port 40 corresponding to the groove 41 is not connected to other compression chambers 27 in a compression process or to the compression chamber 27 connected to the main discharge port 25*h*. When the auxiliary discharge ports 40 are formed in the orbiting base plate 26*a*, the refrigerant gas discharged from the auxiliary discharge ports 40 is discharged, for example, into the back pressure chamber S3.

In the above-described embodiment, the auxiliary discharge ports 40 may be formed in the orbiting base plate 26*a* in addition to those in the fixed base plate 25*a*. In other words, the auxiliary discharge ports 40 may be formed in at least one of the fixed base plate 25*a* and the orbiting base plate 26*a*. The grooves 41 may be formed in the base plate in which the auxiliary discharge ports 40 are provided. The phrase "at least one of" as used in this disclosure means "one or more" of two options. That is, the phrase means "only one of the two options" or "both of the two options." For example, at least one base plate of the fixed base plate 25*a* and the orbiting base plate 26*a* means one of the fixed base plate 25*a* and the orbiting base plate 26*a* or both of the fixed base plate 25*a* and the orbiting base plate 26*a*.

In the above-described embodiment, the auxiliary discharge ports 40 do not necessarily need to be connected to the first ends of the grooves 41 in the extending direction, but may be connected to middle sections in the extending direction of the grooves 41. In this case, each auxiliary discharge port 40 is not connected to a compression chamber 27 from the time at which compression of refrigerant gas is started in the compression chamber 27. Instead, the first end in the extending direction of each groove 41 is connected to a compression chamber 27 from the time at which compression of refrigerant gas is started in the compression chamber 27. In short, one of the groove 41 and the auxiliary discharge port 40 may be connected to the compression chamber 27 from the time at which compression of refrigerant gas is started in the compression chamber 27.

In the above-described embodiment, the grooves 41 and the auxiliary discharge ports 40 do not necessarily need to be connected to a compression chamber 27 from the time at which compression of refrigerant gas is started in the compression chamber 27.

In the above-described embodiment, the auxiliary discharge ports 40 do not necessarily need to extend through the fixed base plate 25*a* in the thickness direction. In this case, each groove 41 is connected to the opening of the corresponding auxiliary discharge port 40 provided in the volute wall forming surfaces. As described above, when the auxiliary discharge ports 40 do not extend through the fixed base plate 25*a*, the diameter of each auxiliary discharge port 40 may be larger than the width of the orbiting volute wall 26*b*.

In the above-described embodiment, a reed valve for opening and closing the main discharge port 25*h* and reed valves for opening and closing the auxiliary discharge ports 40 may be provided as separate members on the surface of the fixed base plate 25*a* opposite to the fixed volute wall 25*b*.

In the above-described embodiment, the number of the auxiliary discharge ports 40 is not particularly limited, but may be one or greater than two. The number of the grooves 41 is changed in correspondence with the number of the auxiliary discharge ports 40.

In the above-described embodiment, the shape of the grooves 41 is not limited to a curved shape extending along the fixed volute wall 25*b*.

In the above-described embodiment, the number of the suction ports 38, which are formed in the fixed outer peripheral wall 25*c* of the fixed scroll 25 may be one or greater than two. That is, the number of the suction ports 38, which are formed in the fixed outer peripheral wall 25*c*, is not particularly limited.

In the above-described embodiment, there may be a time at which the grooves 41 are completely covered with the orbiting volute wall 26*b*. At this time, the compression chambers 27 in the compression process are not connected to each other via the grooves 41. In such a case, each groove 41 is covered with the orbiting volute wall 26*b* only for such a period that the pressure in each compression chamber 27 does not become abnormally high even if each groove 41 is entirely covered with the orbiting volute wall 26*b*.

In the above-described embodiment, the scroll compressor 10 does not need to be of a type that is driven by the electric motor 22, but may be of a type that is driven by a vehicle engine.

In the above-described embodiment, the scroll compressor 10 is used in the vehicle air conditioner. However, the scroll compressor 10 may be used in other apparatuses. For example, the scroll compressor 10 may be mounted on a fuel cell electric vehicle and compress air which is fluid supplied to a fuel cell.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A scroll compressor, comprising:

a fixed scroll that includes a fixed base plate and a fixed volute wall extending from the fixed base plate; and an orbiting scroll that includes an orbiting base plate and an orbiting volute wall, the orbiting base plate facing the fixed base plate, and the orbiting volute wall extending from the orbiting base plate toward the fixed base plate and meshing with the fixed volute wall, wherein the fixed scroll and the orbiting scroll define compression chambers, the fixed base plate includes a main discharge port at a center of the fixed base plate, the main discharge port discharging a compressed fluid, at least one of the fixed base plate or the orbiting base plate includes an auxiliary discharge port located at a position different from a position of the main discharge port, the auxiliary discharge port is configured to discharge fluid in one of the compression chambers when a pressure in the compression chamber becomes greater than or equal to a preset pressure, the fixed base plate and the orbiting base plate include volute wall forming surfaces provided with the corresponding volute walls, the volute wall forming surface of the base plate that includes the auxiliary discharge port includes an opening of the auxiliary discharge port, the base plate also including a groove connected to the opening, the groove is configured to be always connected to one of the compression chambers, and the groove is configured to be partially covered with the volute wall facing the groove, so that the compression chamber that is in a compression process and is connected to the auxiliary discharge port is not connected to other compression chambers in a compression process or to the compression chamber connected to the main discharge port.

2. The scroll compressor according to claim 1, wherein a width of the groove is smaller than a width of one of the fixed volute wall and the orbiting volute wall that overlaps with the auxiliary discharge port.

3. The scroll compressor according to claim 1, wherein one of the groove or the auxiliary discharge port is configured to be connected to one of the compression chambers from a time at which fluid starts being compressed in the compression chamber.

4. The scroll compressor according to claim 1, wherein the auxiliary discharge port and the groove are formed in the fixed base plate, and a reed valve that opens and closes the main discharge port and the auxiliary discharge port is provided on a surface of the fixed base plate opposite to the volute wall forming surface.

5. The scroll compressor according to claim 1, wherein the auxiliary discharge port is one of two auxiliary discharge ports, the two auxiliary discharge ports are provided on opposite sides of the main discharge port, and the groove is one of two grooves that are respectively connected to the two auxiliary discharge ports.

6. The scroll compressor according to claim 1, wherein the groove has a curved shape that extends along the volute wall that extends from the base plate, which includes the auxiliary discharge port.

* * * * *